United States Patent [19]

Richards et al.

[11] 4,325,319

[45] Apr. 20, 1982

[54] AIR FLOW SYSTEM FOR THE CHARGING CONDUCTOR IN AN ELECTROSTATIC PAINTING SYSTEM

[75] Inventors: Thomas J. Richards, Peoria; Robert G. Smead, St. Charles; Paul J. Staebler, Dunlap, all of Ill.

[73] Assignee: Caterpillar Tractor Co., Peoria, Ill.

[21] Appl. No.: 145,068

[22] PCT Filed: Jan. 18, 1980

[86] PCT No.: PCT/US80/00047

§ 371 Date: Jan. 18, 1980

§ 102(e) Date: Jan. 18, 1980

[87] PCT Pub. No.: WO81/01967

PCT Pub. Date: Jul. 23, 1981

[51] Int. Cl.[3] ..... B05B 5/02

[52] U.S. Cl. ..... 118/634; 118/630

[58] Field of Search ..... 118/715, 720, 728, 729, 118/730, 63, 58, 504, 64; 427/33, 27

[56] References Cited

U.S. PATENT DOCUMENTS

| | | | |
|---|---|---|---|
| 2,442,986 | 6/1948 | Ransburg | 427/33 |
| 2,805,642 | 9/1957 | Tuttle et al. | 118/635 |
| 3,652,331 | 3/1972 | Yamazaki | 118/715 X |
| 3,750,620 | 6/1979 | Eversteijn et al. | 118/725 |
| 4,158,344 | 6/1979 | Bagby et al. | 118/630 |

FOREIGN PATENT DOCUMENTS

| | | | |
|---|---|---|---|
| 961333 | 4/1957 | Fed. Rep. of Germany | 118/630 |
| 581503 | 11/1976 | Switzerland | 118/630 |

*Primary Examiner*—Bernard D. Pianalto

*Attorney, Agent, or Firm*—Wegner, Stellman, McCord, Wiles & Wood

[57] ABSTRACT

An electrostatic painting system has a charged conductor (22) extending along the path of travel of article carriers (11) through a coating zone (15, 16). A plenum (33) with a perforate wall (25) extends along the length of the charged conductor and is connected with a blower (30). A unidirectional flow of air is directed across the charged conductor.

15 Claims, 4 Drawing Figures

AIR FLOW SYSTEM FOR THE CHARGING CONDUCTOR IN AN ELECTROSTATIC PAINTING SYSTEM

TECHNICAL FIELD

This invention relates generally to an electrostatic painting system and more particularly to an air flow system for preventing deposition of paint on a charged conductor used to charge an article isolated from ground, being painted in an electrostatic painting system.

BACKGROUND ART

Electrostatic painting systems are known in which the articles painted are electrically charged. Typically, articles are carried through a painting zone by a conveyor with the articles and article carriers isolated from electrical ground. In the painting zone a charged conductor extends along the conveyor path. A charge collector on the article carrier is spaced from the charged conductor and an electric charge is transferred to the carrier and thus to the article supported therefrom. The electric potential on the conductor may be of the order of 75 kV to 100 kV. An undesirable discharge or arcing may occur from the charged conductor. This condition is aggravated by the presence of dirt, paint particles or the like. It is known to enclose the charged conductor in a housing and to blow air through the housing thus minimizing the build-up of charged particles. In prior systems, the air flow around the charged conductor is turbulent or nonuniform. Outside air, which may contain paint particles, is drawn into the enclosure. Swirls or eddies form allowing charged paint particles and other contaminants to enter the field of the charged conductor and to be deposited on the conductor and on the supporting structure therefor. This causes undesirable coating of the charged conductor and inhibits ionization of the air surrounding the conductor and charge transfer to the charge collector on the article carrier. The voltage gradient between the conductor and the collector may become excessive in the absence of ionization of the air and disruptive sparking may occur. Conversely, if the air around the conductor is contained, the concentration of ionized particles may become excessive, lowering the resistance to ground and causing an undesirable current flow to the collector or to ground.

DISCLOSURE OF INVENTION

The present invention is directed to overcoming one or more of the problems as set forth above.

According to the present invention an improved air flow system includes a blower, means defining a plenum chamber extending along the length of the charged conductor, means for directing a flow of air from the blower through the plenum chamber and a perforate wall between the plenum chamber and the charged conductor, a flow of air being directed through the perforate wall and outward from the wall across the charged conductor.

The uniform flow of air across the charged conductor prevents the paint particles from depositing on the conductor and avoids the problems noted above. The uniformity of flow is characterized by freedom from swirls and eddies so that paint particles are not drawn to localized areas of the conductor.

The invention enables operation of a coating system for an extended period of time without need to clean the charged conductor.

BEST MODE FOR CARRYING OUT THE INVENTION

Figures 1, 2, 3, 4:
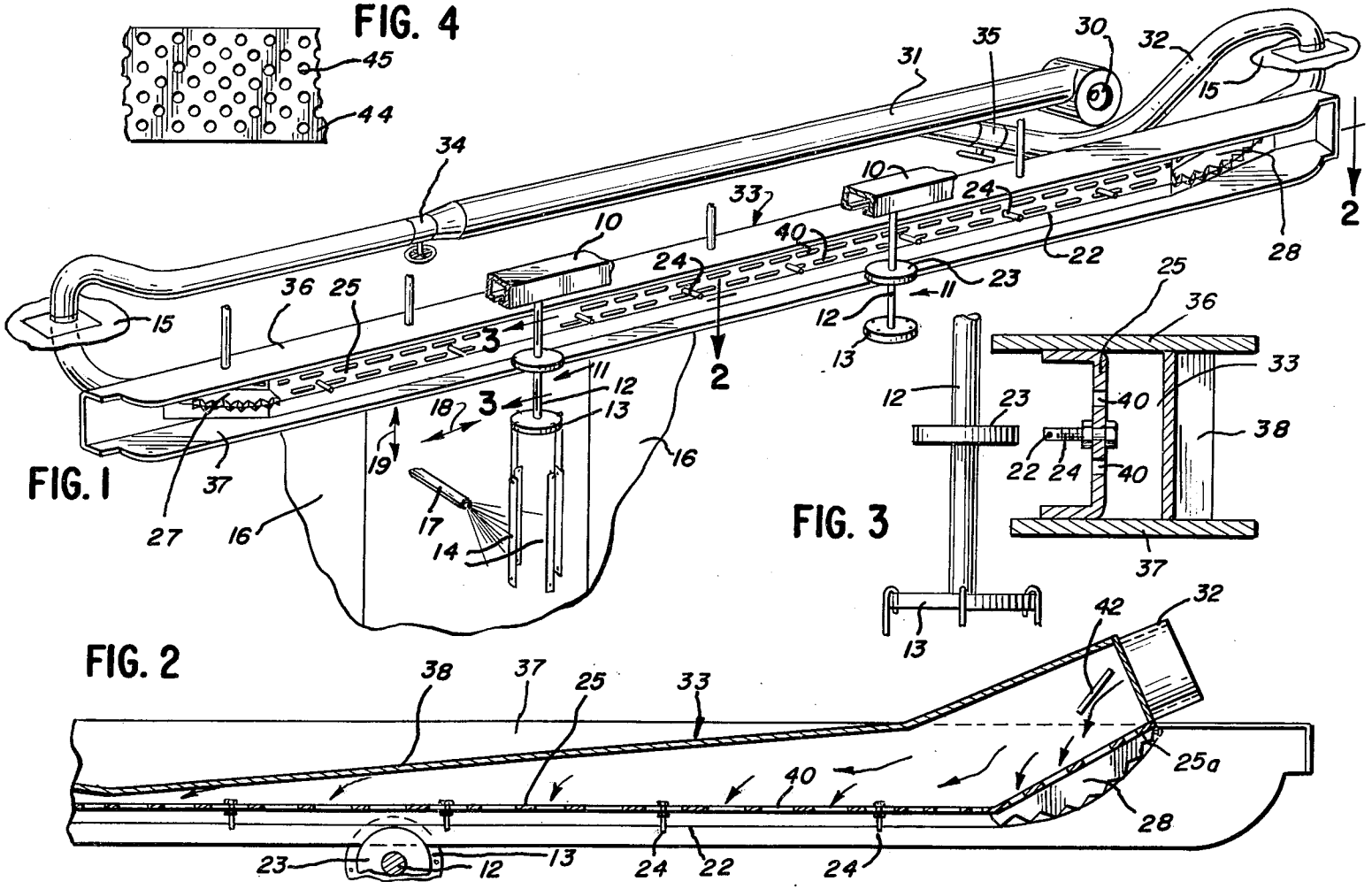
FIG. 1 is a diagrammatic perspective of a painting installation illustrating the invention.
FIG. 2 is an enlarged fragmentary section taken generally along line 2—2 of FIG. 1.
FIG. 3 is an enlarged section taken along line 3—3 of FIG. 1.
FIG. 4 is a fragmentary elevation illustrating an alternate form of perforate wall.

The painting installation of FIG. 1 has an overhead conveyor with a conveyor track 10 and wheeled article carriers 11 which are drawn along the conveyor track as by a chain, not shown. A depending carrier member 12 supports a rack 13 from which articles 14, which are to be painted, are suspended.

The conveyor 10 passes through a coating zone within a paint booth defined by walls, including a top wall 15 and front wall 16, and end and rear walls which are not shown. A paint gun 17 provides a source of particulate paint and is spaced from the path of article travel, adjacent the front of the paint booth. The paint gun is preferably triggered on as articles to be painted pass through the painting booth. The gun may be fixed or may be reciprocated laterally and vertically as indicated by arrows 18, 19 if such movement is desirable to deposit an adequate coating on the articles.

In a preferred coating system, the paint gun is electrically charged, as to a negative potential of the order of 25 kV and the articles to be coated are charged with a positive potential of the order of 75–100 kV. The articles to be coated, and the article carriers, have a charge transferred thereto from a charged conductor, here shown as a wire 22 which extends along the path of travel of the article carriers in the coating zone within the paint booth. A disc-shaped charge collector 23 mounted at an intermediate point on carrier member 12 travels in close proximity to the charged conductor and acquires a charge therefrom which is conductively coupled through the carrier and rack to the articles 14. The conveyor 10 is electrically grounded and the upper portion of carrier member 12 includes an isolation resistor so that the charge transferred to the collector 23 is not immediately dissipated to ground.

In the system described some of the paint particles have a negative charge, others have a positive charge and some are uncharged. There is a tendency for the paint particles, and particularly those which have a negative charge, opposite to that of the positively charged conductor, to be attracted to and deposit on the conductor or its supporting structure. This reduces charge transfer to collector 23 and promotes sparking as discussed above.

In accordance with the invention, a flow of air is directed across the charged conductor 22 counteracting the electrostatic force attracting the paint particles toward the conductor. This greatly reduces the deposition of paint particles on the conductor and minimizes the arcing problem. The air flow is essentially unidirectional along the length of the conductor although the velocity may not be the same at all points. It is important that the air flow across the conductor be free of swirls and eddies which may draw the paint particles to some sections of the charged conductor rather than keeping them away.

The charged conductor 22 is mounted on posts 24 of an insulating material which extend generally horizontally from a plate 25 also of insulating material. At each end of the coating zone, the charged conductor 22 is supported by insulating plates 27, 28 which have an arcuate configuration with a scalloped edge. The conductor extends along the arcuate scalloped edge so that the spacing between the conductor and charge collector 23 gradually decreases as the article carrier enters the coating zone and increases as the carrier leaves the coating zone. This affords a gradual build-up of the particle potential at entry and avoids an abrupt field termination at the exit. The scalloped edges of plates 27, 28 support conductor 22 on a series of knife edges minimizing conductor contact with the supporting surface. This is desirable as contact between the conductor and a surface reduces ionization of air around the conductor and the charge transfer to collector 23. The charged conductor 22 is connected at one end to a source of high voltage, not shown.

A blower 30 is located outside the paint booth, as above top wall 15. Intake air for the blower may be filtered room air or may be filtered, temperature and humidity controlled air from the spray booth makeup plenum, not shown. The blower discharge is connected through conduits or ducts 31, 32 with each end of a plenum chamber 33 extending the length of the charged conductor. Dampers 34, 35 are adjusted to balance the air flow to each end of the plenum. The chamber is defined by top and bottom walls 36, 37, rear wall 38 and wall 25 which is between the plenum and the charged conductor and which is perforated or porous to allow air to flow therethrough. The walls of the plenum are all of insulating material. The charged conductor 22 and the plenum chamber 33 are oriented in the paint booth so that the chamber is physically located between the paint gun 17 and the conductor. The only paint particles which approach the charged wire are those which are mechanically projected beyond the articles 14 and are not otherwise dissipated.

Air from conduits 31, 32 enters the plenum moving in opposite directions, generally parallel with the longitudinal extent of the charged conductor 11. The air flows out through a plurality of slots 40 in wall 25 and across the charged conductor. The cross sectional area of plenum 33 is tapered, becoming smaller as the distance from the conduits 31, 32 increases so that the rate of air flow outwardly across the charged conductor is substantially uniform from one end to the other. Along the length of perforate wall 25, the direction of air flow within the plenum is parallel with the longitudinal extent of charged conductor 22 and the wall surface. The air flow must change direction to pass from the plenum through the slots. This avoids localized variations in air velocity which might occur if, for example, the air entered the plenum at right angles to the wall and went directly through some of the slots. The air flow has a substantial component directed outwardly from the wall 25 across conductor 22 along the entire length of the conductor. Outside air is not drawn into the area surrounding the conductor.

Adjacent the curved plate 28, as shown in FIG. 2, a section 25*a* of wall 25 extends across a chord of the curved end portion of conductor 22. A baffle 42 in the plenum directs a portion of the air flow along wall section 25*a* so that there is an adequate air flow across the plate 28 and the portion of the conductor which is supported thereon.

The plenum wall 25 shown in FIGS. 1, 2 and 3 has two rows of slots 40 therein. One row is above charged conductor 22 and the other row is below. The ends of the slots are staggered to minimize air flow variations.

An alternate form of the perforate wall is illustrated in FIG. 2. The wall 44, rather than having slots, has holes 45 formed therein which are of such a size and spacing that they afford a flow factor of the order of 50%. In other words, roughly one-half the surface area of wall 25 is solid and the other half is open.

The top and bottom walls 36, 37 of plenum 33 extend beyond wall 25 and charged conductor 22. This restricts the flow of air preventing its expansion and reduction in velocity until it is at a point beyond the charged conductor. In one system which has been found satisfactory, the charged conductor 22 is 28.5 mm ($1\frac{1}{8}$ inch) from the surface of wall 25, and the edge of lower plate 37 is 48 mm ($2\frac{5}{8}$ inch) outside the conductor.

The velocity of air flow needed to minimize deposition of charged paint particles on the conductor depends on factors such as the charge on the particles, their mass and diameter and the charge on the conductor. In one system a flow velocity in the range of 2 to 3 m/s (400 to 600 ft/min) across the wire has been found satisfactory.

INDUSTRIAL APPLICABILITY

Articles 14 are transported by conveyor 10 and article carriers 11 through the painting zone defined by the booth. As the articles enter the booth, charge collector 23 approaches charged conductor 22 and an electric charge is induced on the carrier and the articles. Paint particles from gun 17 are attracted to and deposited on the articles. The air flow from blower 30 is directed to the tapered plenum 33 and distributed uniformly along the length of charged conductor 22 through perforate wall 25. The air flow outwardly across the conductor prevents paint particles and other contaminants from depositing on the conductor.

Other aspects, objects and advantages of this invention can be obtained from a study of the drawings, of the disclosure and the appended claims.

We claim:

1. In an electrostatic painting system having a conveyor (10) with a plurality of article carriers (11) which pass through a coating zone and means for electrically charging articles as they pass through the coating zone (15, 16), including a charged conductor (22) extending along the path of travel of the article carriers and a charge collector (23) on each carrier having a path of travel adjacent the charged conductor to transfer a potential to the article carrier and to articles (14) carried thereby, an improved air flow system for preventing the deposition of paint particles on said charged conductor, comprising:

a blower (30);

means defining a plenum chamber (33) extending along the length of said charged conductor;

means (31, 32) for directing a flow of air from said blower through said plenum chamber; and a perforate wall (25) between said plenum chamber and said charged conductor, a flow of air being directed through said perforate wall (25) outwardly across said charged conductor (22).

2. The air flow system of claim 1 wherein the relationship between the flow of air through said plenum (33) and through said perforate wall (25) is such that the air flow across said charged conductor (22) has a substantial component outward from the wall, along the length of the charged conductor.

3. The air flow system of claim 1 wherein the flow of air through the perforate wall (25) is generally at right angles to the flow of air through said plenum (33).

4. The air flow system of claim 1 wherein the flow of air through said plenum (33) is generally parallel with the longitudinal extent of said charged conductor (22) and the flow of air through said perforate wall (25) has a component generally at right angles to the flow through said plenum and to the longitudinal extent of said charged conductor.

5. The air flow system of claim 1 including a conduit (31, 32) connecting said blower (30) with one end of said plenum (33), the cross sectional area of the plenum being tapered from said one end toward said other end so that the rate of air flow outwardly through said perforate wall (25) and across said charged conductor (22) is substantially uniform along the length of said conductor.

6. The air flow system of claim 1 having a conduit (31, 32) connecting said blower (30) with said plenum (33), the flow of air at the junction of the conduit with the plenum having a direction generally parallel the longitudinal extent of said charged conductor (22).

7. The air flow system of claim 1 having a pair of plates (36, 37) extending from said perforate wall beyond said charged conductor (22) one on either side thereof, to restrict expansion of the flow of air across said charged conductor.

8. The air flow system of claim 1 having a baffle (42) in said plenum to direct flow of at least a portion of the air through said perforate wall.

9. The air flow system of claim 1 wherein said charged conductor (22) is located between said perforate wall (25) and the path of travel of said article carriers (11), said charged conductor (22) having a straight center portion with a curved end portion extending away from the path of travel of the article carriers, and the perforate wall has a section (25*a*) extending across a chord of said curved conductor end portion.

10. The air flow system of claim 9 having a baffle (42) in said plenum to direct the flow of a portion of the air through the section (25*a* ) of perforate wall extending across a chord of the curved conductor end portion.

11. The air flow system of claim 5 having two conduits (31, 32) extending from the blower (30) to the plenum (33), one conduit connecting the blower with each end of the plenum, the cross sectional area of the plenum being tapered from each end toward the center with the minimum area at the center.

12. The air flow system of claim 1 in which said wall (25) is perforated with slots (40) therethrough extending parallel with the longitudinal extent of said charged conductor, there being a plurality of slots across the width of the wall, the ends of said slots being staggered longitudinally.

13. The air flow system of claim 1 in which said perforate wall (44) is perforated with holes (45) therethrough.

14. The air flow system of claim 13 in which said perforate wall (40) has a flow factor of the order of 50%.

15. The air flow system of claim 1 having a source (17) of particulate paint operably associated with said coating zone (15, 16), said plenum (33) being physically located between said paint source and said charged conductor (22).

* * * * *